United States Patent [19]

Aoyama

[11] Patent Number: 4,758,183

[45] Date of Patent: Jul. 19, 1988

[54] ELECTRICAL CONNECTOR WITH A WIRE COVER

[75] Inventor: Kohji Aoyama, Tokyo, Japan

[73] Assignee: AMP Incorporated, Harrisburg, Pa.

[21] Appl. No.: 12,525

[22] Filed: Feb. 9, 1987

[30] Foreign Application Priority Data

Mar. 31, 1986 [JP] Japan ..... 61-048030[U]

[51] Int. Cl.[4] ..... H01R 13/40

[52] U.S. Cl. ..... 439/596

[58] Field of Search ..... 339/44 R, 44 M, 59–61; 439/36, 75 M, 76, 184 M, 210 R, 210 M, 63 R, 63 M, 206

[56] References Cited

U.S. PATENT DOCUMENTS

| | | | |
|---|---|---|---|
| 3,693,134 | 9/1972 | Trevisiol | 339/59 M |
| 3,842,388 | 10/1974 | Harwood et al. | 339/59 R |
| 3,937,545 | 2/1976 | Cairns et al. | 339/60 |
| 4,066,325 | 1/1978 | Pearce, Jr. et al. | 339/176 MP |
| 4,200,350 | 4/1980 | Zimmerman, Jr. | 339/91 R |
| 4,311,355 | 1/1982 | Plyler et al. | 339/94 R |
| 4,343,523 | 8/1982 | Cairns et al. | 339/59 M |
| 4,413,872 | 11/1983 | Rudy, Jr. et al. | 339/59 M |
| 4,436,359 | 3/1984 | Kasper et al. | 339/61 M |
| 4,472,012 | 9/1984 | Michaels | 339/63 M |
| 4,544,220 | 10/1985 | Aiello et al. | 339/59 M |
| 4,557,542 | 12/1985 | Coller et al. | 339/59 M |
| 4,607,903 | 8/1986 | Hoshino et al. | 339/59 R |
| 4,655,525 | 4/1987 | Hunt, III et al. | 339/63 M |

FOREIGN PATENT DOCUMENTS 1315693 5/1973 United Kingdom .

*Primary Examiner*—Gil Weidenfeld
*Assistant Examiner*—Paula A. Austin
*Attorney, Agent, or Firm*—Robert W. Pitts

[57] ABSTRACT

An electrical connector comprises a dielectric housing having contact-receiving passages in which electrical contacts terminated to ends of electrical wires are disposed. Movable locking members are hingedly mounted on the housing and they permit the contacts while in a first position to be positioned in the passages and the locking members are movable to a latched second position maintaining the contacts in the passages. A cover member is mounted on the housing and is latched onto projections of the locking members only when the locking members are in the latched second position.

9 Claims, 2 Drawing Sheets

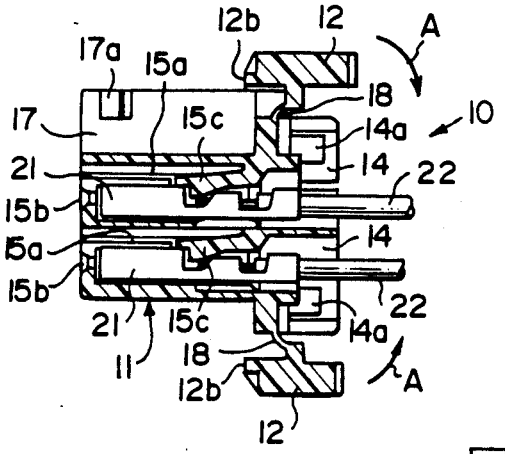
FIG. 2
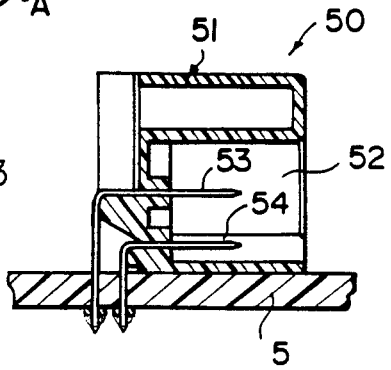
FIG. 3
FIG. 4
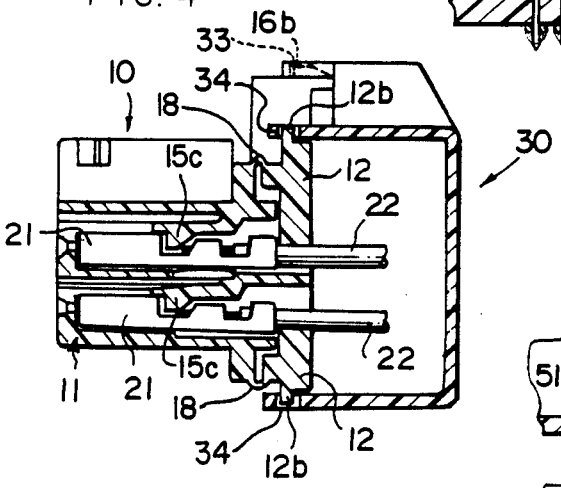
FIG. 5
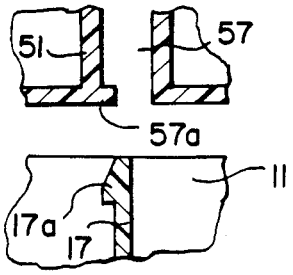

ELECTRICAL CONNECTOR WITH A WIRE COVER

FIELD OF THE INVENTION

This invention is related to an electrical connector with a wire cover having a structure wherein the wire cover is mounted onto the connector and which retains electrical contacts in position in the connector and also directs the electrical wires terminated to the contacts which extend outward from the connector in a specified direction.

BACKGROUND OF THE INVENTION

A connector wherein contacts are arranged and retained inside an insulated housing and each contact is respectively connected with end portions of electrical wires has been widely used in practice. The connector mates with a complementary connector which is mounted on equipment to which the wires are to be connected, and opposed contacts retained in the complementary connector are connected with each of these contacts, whereby an electrical connection is established. However, when the connector is connected to the complementary connector, the plurality of wires connected to each contact inside the connector and extending outward are likely to become an obstacle, and therefore, in many cases, a wire cover, which guides these wires collectively in a specified direction, is fitted to the connector. Further, in such a connector including many contacts, an insertion force created by an engagement of the contacts is increased, and therefore, a screw is used to mate one connector with the other connector. In such a case, if the wires are located at the screw location, the wires can become an obstacle because the screw can become entangled with the wires. Therefore, the wires are led in a specified direction by the wire cover to facilitate the operation of the screw.

On the other hand, it is possible that the contacts retained in the housing of the connector may be pulled out if a pulling force is exerted on the wires connected to the contacts. Accordingly, various ways of securely retaining the contacts in the housing have been studied. For example, a hinge lock type connector is known in which a movable locking member is attached to the housing through a hinge, and after the contacts are retained in the housing, a part of passages receiving the contacts is covered by the locking member to prevent the contacts from being pulled out. Accordingly, the contacts can be reliably prevented from being pulled out. However, since the locking member is covered by the wire cover in mounting the wire cover onto this hinge lock type connector, the wire cover may be mounted on the connector without securing the locking member in position, and thus a problem arises in that the contacts may pull out with the result that an incomplete electrical connection is established.

SUMMARY OF THE INVENTION

In consideration of the aforementioned problems, the object of this invention is to provide an electrical connector with a wire cover in which the wire cover cannot be fitted onto the connector without closing the locking member to prevent the contacts from being pulled out, and thus assures the closing of the locking member.

This invention concerns the structure of a wire cover for an electrical connector having a housing in which a plurality of contacts are secured in passages therein and a movable locking member which is attached to the connector member by a hinge, a plurality of wires extend outward from a rear surface of the connector and are collectively directed in a specified direction by the wire cover. The locking member is provided with a projection which projects outward when the locking member covers a part of the passages in the connector in which the contacts are retained and the wire cover has an engaging portion which engages with the projection, whereby the contacts are prevented from being pulled out when the wire cover is mounted on the connector member.

BRIEF DESCRIPTION OF THE DRAWINGS

FIG. 2 is a cross-sectional view showing a plug connector along the line II—II in FIG. 1.

FIG. 3 is a cross-sectional view showing a receptacle connector along the line III—III in FIG. 1.

FIG. 4 is a cross-sectional view showing the wire cover retained by the plug connector.

FIG. 5 is a part cross-sectional view of FIG. 1 along the line V—V.

DETAILED DESCRIPTION OF THE INVENTION

Figure 1:
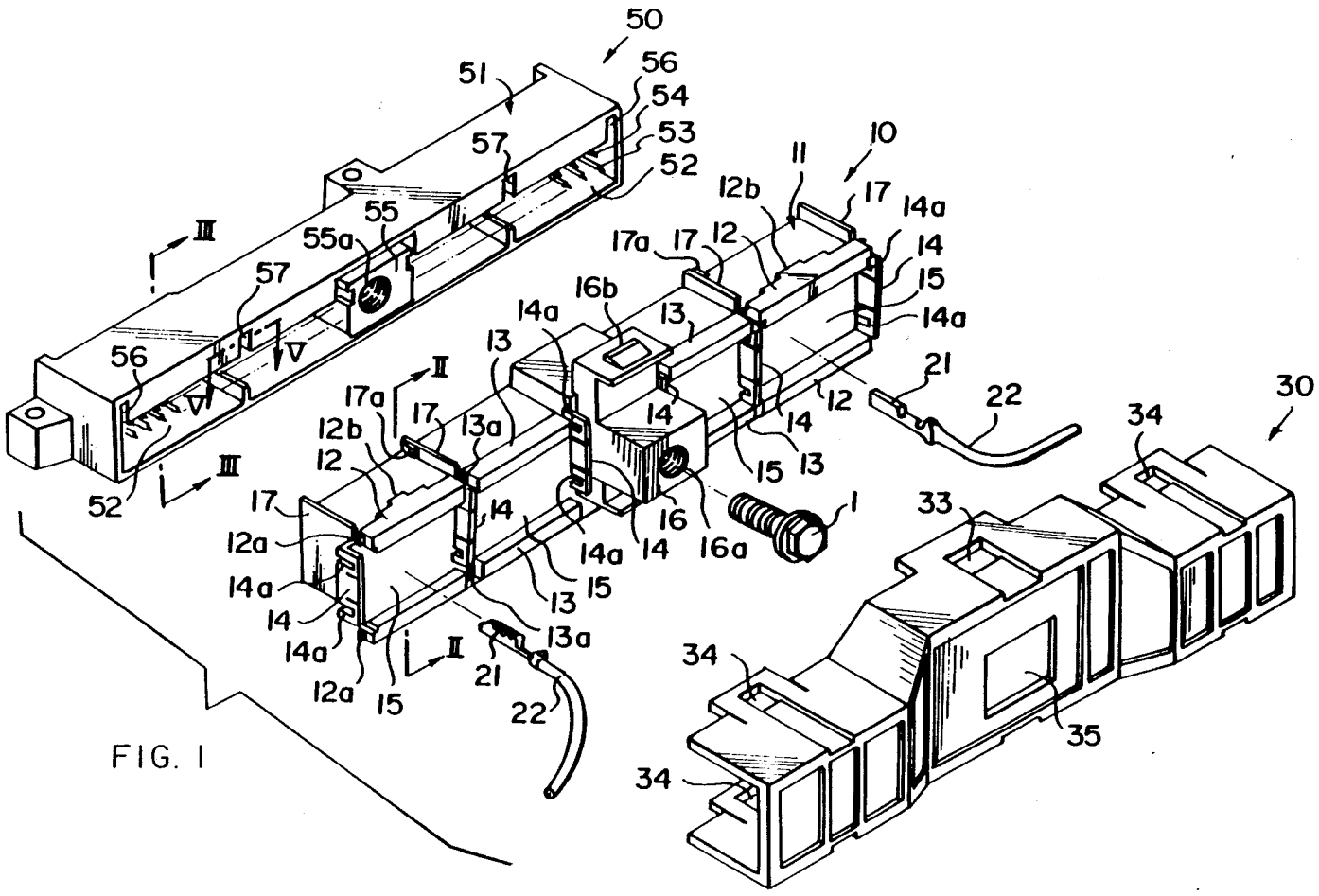
FIG. 1 is a perspective exploded view of matable electrical connectors and a wire cover having a retaining structure according to the invention.

The following is an explanation of the preferred embodiment of this invention by way of example with reference to the drawings.

FIG. 1 is a perspective exploded view showing an electrical connector, and a wire cover according to this invention. In FIG. 1, a wire cover 30 is mountable to a plug connector 10 to be engaged and connected with a receptacle connector 50.

The plug connector 10 has a plug housing 11 which is formed with contact-receiving sections 15 wherein a plurality of female electrical contacts 21 terminated to end portions of a plurality of wires 22 are inserted and arranged in two rows as shown in FIG. 2. As seen in FIGS. 1 and 2, the contact-receiving sections 15 are formed with a plurality of contact passages **15*a* which receive the contacts 21, and each contact 21 is retained within contact passages 15*a* as shown in FIG. 2. Further, integral flexible latching arms 15*c* are formed inside these contact passages, and when the contacts 21 are inserted, the tips of the arms 15*c* are engaged with the contacts 21 to latch the contacts 21 in position in passages 15*a*. The contact passages 15*a* are formed with contact insertion openings 15*b* in the front wall containing the mating surface of housing 11, and when the plug connector 10 is mated with the receptacle connector 50, male contacts 53,54 inside this receptacle connector 50 pass through the contact insertion openings 15*b* and are electrically connected with the respective female contacts 21**.

The contact-receiving sections 15 are separated by vertical partition walls 14, and the upper and lower portions of the two sections 15 located at both outer ends are provided with movable locking members 12 which are mounted to the upper and lower portions by hinges 18 whereas the upper and lower portions of sections 15 are provided with movable locking members 13 which are also mounted thereto by hinges 18. Furthermore, a center support 16 having a through hole 16 for receipt of a fastening bolt 1 is located at a center part of housing 11. Cover-engaging projections 16*b* are provided at the upper and lower surfaces of center support 16. Also, latching apertures 14*a* are formed in the upper and lower portions, respectively, of the partition walls 14, and latching projections 12*a*, 13*a* formed at both sides of the locking members 12,13 are latchably engageable with these latching apertures 14*a*.

FIGS. 1 and 2 show the locking members 12,13 in the open position and facing outward. When the locking members 12,13 are moved and closed in the direction of the arrow A shown in FIG. 2, the latching projections 12*a*,13*a* are latched in the latching apertures 14*a* by the elastic deformation of the partition walls 14, and the locking members 12,13 are thus latchably maintained in the closed position. Further, end locking members 12 are provided with engaging projections 12*b* projecting outward (upward or downward) when the locking members 12 are latchably closed as shown in FIG. 4. Also, polarizing members 17 are located at an upper surface of housing 11, and two of the inner polarizing members are provided with temporary fastening projections 17*a*.

As shown in FIG. 3, the receptacle connector 50 to be mated with the plug connector 10 has a receptacle housing 51 having an opening 52 wherein the plug connector 10 is inserted and male contacts 53,54 having one end extending into opening 52 are arranged vertically in two rows in housing 51. The other end of each male contact 53,54 projects downward from the housing 51. The arrangement of these male contacts 53,54 corresponds to the arrangement of the female contacts 21 in the plug contact 10, thus the corresponding contacts are electrically connected when the plug connector 10 is connected with the receptacle connector 50.

The receptacle housing 51 is mounted on a printed circuit board 5, and the other ends of the male contacts 53,54 which project downward from the housing 51 are connected with the circuit paths of board 5. Moreover, slots 56,57, which extend backward from the mating surface, are formed inside the upper walls of the housing 51. These slots 56,57 correspond to the polarizing walls 17 formed on the plug housing 11, and the polarizing walls 17 are engaged with the slots 56,57 when the connectors 10,50 are mated. Therefore, the connectors 10,50 are properly mated without mismating between them. Further, as shown in FIG. 5, slots 57 are provided with rojecting walls 57*a* inside the entrance thereof. This projecting side wall 57*a* engages with a temporary fastening projection 17*a* on polarizing wall 17 of the plug connector housing 11. The temporary fastening projection 17*a* is allowed to enter the slot 57 by sliding over the projecting side wall 57*a* because of the flexibility of the polarizing walls 17, and is latched by the projecting side walls 57*a*. This latching occurs at the early stage of the insertion, and accordingly, the plug connector 10 can be temporarily held in part engagement with connector 50 when only just inserted in the opening 52 of the receptacle connector 50. Also, the center support portion 55 of housing 51 is provided with a nut 55*a* into which the fastening bolt 1 is screwed.

The wire cover 30 has a U-shape in cross section and is open at both ends thereby directing wires 22 extending from the connector 10 collectively in the right and left directions from the open ends as shown in FIG. 1 when cover 30 is mounted onto connector 10. Apertures 33,34 are located at the front ends of the opposing sides of the cover 30 respectively. Apertures 33 at the center portion of cover 30 are latchably engageable with cover engaging-projections 16*b* of the center support portion 16 of the plug housing 11, and the apertures 34 at both ends are latchably engageable with the engaging projections 12*b* when the locking members 12 are closed, as described later. Accordingly, when the abovementioned engagement between projections 12*b*, 16*b* and apertures 34,33 is carried out, the wire cover 30 is retained on the plug connector 10. Further, an opening 35 for bolt 1 is formed at the center of the wire cover 30.

FIG. 4 shows the wire cover 30 retained on the plug connector 10, and the following is an explanation of the engagement and connection between the plug connector 10, the wire cover 30, and the receptacle connector 50 with reference to FIGS. 1 to 4.

First, a plurality of contacts 21 terminated to the end portions of the wires 22 are inserted in the contact passages 15*a* inside the contact-receiving sections 15 of housing 11 with the locking members 12,13 of the plug connector 10 in an open position as shown in FIG. 2. During insertion, the front ends of the contacts 21 push up the latching arms 15*c*, and the contacts are latched by the latching arms 15*c* when fully inserted therein, which limit the backward movement of the contacts 21 within passages 15*a*. Forward movement of contacts 21 within passages 15*a* is limited by the front wall of housing 11. Next, to further ensure that the contacts 21 are prevented from being pulled out, the locking members 12,13 are moved in the direction of the arrow A via the hinge portions 18, and as shown in FIG. 4, the locking members 12,13 are closed and cover a part of contact-receiving sections 15 which also cover a part of passages 15*a*. Latching projections 12*a*,13*a* are disposed in latching apertures 14*a* at the partition walls 14, which ensures that the locking members 12,13 are kept closed. These locking members 12,13 are engaged or in alignment with the rear portions of the contacts 21 inserted in the contact passages 15*a*, and accordingly, the contacts 21 are secured in position by latching arms 15*c* and locking members 12,13 so as to be prevented from being pulled out and also resulting in a double locking arrangement.

When the locking members 12,13 are closed as shown in FIG. 4, the engaging projections 12*b* project outward (upward and downward). Accordingly, when the wire cover 30 is mounted on the plug connector 10, the engaging projections 12*b* of locking members 12 and the cover engaging projections 16*b* at the upper and lower surfaces of the center support portion 16 are disposed respectively within the apertures 33,34 of the wire cover 30, so that the wire cover 30 is retained on the plug connector 10. The wire cover 30 cannot be mounted on the plug connector 10 unless the locking members 12,13 are closed, and thus any oversight in not closing the locking members 12,13 is prevented. At this time, the wires 22, which are connected with the contacts 21 inserted in the right side section 15 of the plug housing 11, are directed collectively along the right side of connector 10 by the right side of the wire cover 30 and outwardly from the connector by the right side opening cover 30. The wires 22, which are connected with the contacts 21 inserted in the left side sections 15, are led collectively along the left side of connector 10 by the left side of the wire cover 30 and outwardly from the connector by the left side opening of cover 30.

Next, the front portion of the plug connector 10 with the wire cover 30 mounted thereon is partly inserted into the opening 52 of the receptacle connector 50, and the plug connector 10 is temporarily held on the receptacle connector 50, as mentioned above. (Note, the wire cover 30 may be mounted on the plug connector 10 after the plug connector is temporarily held on receptacle connector 50.) Subsequently, the fastening bolt 1 is inserted in hole 16*a* through aperture 35 at the center part of wire cover 30, and the bolt 1 is then screwed into the nut 55*a* at the center support portion 55 of the receptacle connector 50. The bolt 1 is gradually tightened, and by this tightening force, the plug housing 10 is completely mated with the receptacle housing 50 even if the connectors have a large number of contacts therein. Also, when tightening the bolt 1, since the wires 22 are shifted to the side by the wire cover 30, the bolt does not become entangled with the wires, and therefore, the fastening operation can be easily carried out.

As explained above, according to this invention, projections are located on the movable locking members, which prevent the contacts from being pulled out. The locking members are located at a position such that the projections project outward only when the locking members are closed, and since the wire cover is retained on the connector by latchable engagement with the projections, the wire cover cannot be retained on the connector unless the locking members are in a closed position; therefore, any oversight in closing the locking members is prevented.

I claim:

1. An electrical connector, comprising:

a dielectric housing having contact-receiving passages extending from a mating surface to a rear surface;

electrical contacts terminated to electrical wires disposed in said contact-receiving passages;

locking means hingedly mounted onto said housing adjacent said rear surface and being movable from a first position permitting said contact to be disposed within said contact-receiving passages and a second position in alignment with the rear ends of the contacts thereby maintaining the contacts in position in the contact-receiving passages;

maintaining means on said housing and said locking means including first means on the housing and second means on said locking means, said first means being engagable with said second means to maintain said locking means in said second position;

cover means mounted on said housing covering portions of said electrical wires and directing them along the rear surface of said housing; and means provided by said locking means and said cover means maintaining said cover means onto said housing but only when said locking means is in said position.

2. An electrical connector as claimed in claim 1, wherein said housing has integral flexible latching arms in said passages engageable with said contacts.

3. An electrical connector as claimed in claim 1, wherein said maintaining means on said housing and locking means comprise latching projections on said locking means that are disposed in apertures in walls of said housing.

4. An electrical connector as claimed in claim 1, wherein said maintaining means of said locking means and said cover means comprise projections on said locking means that are disposed in apertures on said cover means.

5. An electrical connector as claimed in claim 1, wherein said cover means has open ends and extends along at least the length of said housing so as to direct the electrical wires from a central location of said housing outwardly therefrom and from ends of said housing as they extend along the rear surface of said housing.

6. An electrical connector as claimed in claim 1, wherein a complementary electrical connector electrically mates with said electrical connector.

7. An electrical connector as claimed in claim 6, wherein said complementary electrical connector and said electrical connector have polarizing means for proper matable engagement between said complementary electrical connector and said electrical connector.

8. An electrical connector as claimed in claim 7, wherein said polarizing means include means to maintain the electrical connectors in temporary electrical engagement prior to being completely mated.

9. An electrical connector as claimed in claim 8, wherein the electrical connectors include means to move said electrical connectors into complete matable electrical engagement and maintain said electrical connectors thereat.

* * * * *

UNITED STATES PATENT AND TRADEMARK OFFICE

CERTIFICATE OF CORRECTION

PATENT NO. : 4,758,183

DATED : July 19, 1988

INVENTOR(S) : Kohji Aoyama

It is certified that error appears in the above-identified patent and that said Letters Patent is hereby corrected as shown below:

In claim 1, column 6, line 9, after "said" (second occurrence) insert --second--.

Signed and Sealed this

Twenty-second Day of November, 1988

*Attest:*

DONALD J. QUIGG

*Attesting Officer*

*Commissioner of Patents and Trademarks*